US011270852B2

(12) United States Patent
Mori et al.

(10) Patent No.: US 11,270,852 B2
(45) Date of Patent: Mar. 8, 2022

(54) ELECTROMAGNETIC RELAY

(71) Applicant: Omron Corporation, Kyoto (JP)

(72) Inventors: Shingo Mori, Yamaga (JP); Ryota Minowa, Yamaga (JP)

(73) Assignee: Omron Corporation, Kyoto (JP)

( * ) Notice: Subject to any disclaimer, the term of this patent is extended or adjusted under 35 U.S.C. 154(b) by 82 days.

(21) Appl. No.: 16/614,142

(22) PCT Filed: Aug. 9, 2018

(86) PCT No.: PCT/JP2018/029941
§ 371 (c)(1),
(2) Date: Nov. 15, 2019

(87) PCT Pub. No.: WO2019/031587
PCT Pub. Date: Feb. 14, 2019

(65) Prior Publication Data

US 2020/0168408 A1 May 28, 2020

(30) Foreign Application Priority Data

Aug. 10, 2017 (JP) ..... JP2017-155926

(51) Int. Cl.
*H01H 1/54* (2006.01)
*H01H 50/56* (2006.01)
*H01H 50/60* (2006.01)

(52) U.S. Cl.
CPC ..... *H01H 1/54* (2013.01); *H01H 50/56* (2013.01); *H01H 50/60* (2013.01)

(58) Field of Classification Search
CPC ..... H01H 1/54; H01H 50/14; H01H 50/56; H01H 50/60; H01H 50/54; H01H 50/546
(Continued)

(56) References Cited

U.S. PATENT DOCUMENTS 4,467,301 A 8/1984 Goodrich
6,700,466 B1 * 3/2004 Yamamoto ..... H01H 9/443 335/132

(Continued)

FOREIGN PATENT DOCUMENTS

JP H04-233112 A 8/1992
JP 2012-028252 A 2/2012

(Continued)

OTHER PUBLICATIONS

International Search Report issued in PCT/JP2018/029941 dated Sep. 18, 2018 (2 pages).

(Continued)

*Primary Examiner* — Bernard Rojas
(74) *Attorney, Agent, or Firm* — Osha Bergman Watanabe & Burton LLP

(57) ABSTRACT

Provided is an electromagnetic relay including a case, a first fixed contact terminal including a first fixed contact, a second fixed contact terminal including a second fixed contact, and a movable touch piece including, on one surface of the movable touch piece, a first movable contact and a second movable contact configured to come into and out of contact in a contact-making and breaking direction. The first fixed contact terminal includes a facing portion disposed facing the other surface of the movable touch piece with a gap provided between the facing portion and the movable touch piece, and at least part of the facing portion lies over the movable touch piece in plan view in the contact-making and breaking direction.

8 Claims, 11 Drawing Sheets

(58) Field of Classification Search
USPC ..... 335/78, 128, 133, 196
See application file for complete search history.

(56) References Cited

U.S. PATENT DOCUMENTS

| | | | | |
|---|---|---|---|---|
| 8,587,394 | B1 | 11/2013 | Song | |
| 9,281,148 | B2 * | 3/2016 | Enomoto | H01H 50/18 |
| 9,564,279 | B2 * | 2/2017 | Naka | H01H 50/36 |
| 2013/0021121 | A1 | 1/2013 | Uchida | |
| 2013/0021122 | A1 | 1/2013 | Uchida | |
| 2013/0113580 | A1 | 5/2013 | Naka et al. | |
| 2013/0335175 | A1 * | 12/2013 | Tachikawa | H01H 50/546 335/147 |
| 2013/0342294 | A1 | 12/2013 | Aarskog | |
| 2014/0015627 | A1 | 1/2014 | Uchida | |
| 2014/0035705 | A1 | 2/2014 | Uchida | |
| 2014/0062627 | A1 | 3/2014 | Naka et al. | |
| 2014/0266522 | A1 | 9/2014 | Naka et al. | |
| 2016/0071677 | A1 | 3/2016 | Neuhaus | |
| 2017/0110275 | A1 | 4/2017 | Yang | |

FOREIGN PATENT DOCUMENTS

| | | | |
|---|---|---|---|
| JP | 2013-025906 | A | 2/2013 |
| JP | 2013-041815 | A | 2/2013 |
| JP | 2014-110165 | A | 6/2014 |
| JP | 5778989 | B2 | 9/2015 |
| JP | 2016-522548 | A | 7/2016 |
| JP | 2017-076616 | A | 4/2017 |

OTHER PUBLICATIONS

Written Opinion of the International Searching Authority issued in PCT/JP2018/029941 dated Sep. 18, 2018 (8 pages).
Office Action issued in the counterpart Japanese Patent Application No. 2017-155926, dated Nov. 24, 2021 (8 pages).

* cited by examiner

ELECTROMAGNETIC RELAY

TECHNICAL FIELD

The present disclosure relates to an electromagnetic relay and more particularly relates to a connection terminal of the electromagnetic relay.

BACKGROUND ART

Conventionally, an electromagnetic relay that opens and closes a current path is connected to a power supply source and other electronic components through a bus bar. Examples of such electromagnetic relays include an electromagnetic relay disclosed in Patent Document 1. A description will be given of the electromagnetic relay disclosed in Patent Document 1 with reference to FIG. 22. FIG. 22 is an explanatory diagram showing a current flow in a state where the electromagnetic relay disclosed in Patent Document 1 is closed.

According to Patent Document 1, bringing a pair of contact portions 130a of a movable contact 130 into contact with respective fixed contacts 118a of fixed contacts 111 and 112 causes a current Ip to flow. Further, in the fixed contacts 111 and 112, contact conductors 115 each including the fixed contact 118a have a C shape and an inverted C shape, thereby generating a section where directions in which the current Ip flows through each of the contact conductors 115 and the movable contact 130 are opposite to each other. In the section, an electromagnetic repulsive force generated by the Lorentz force caused by the current Ip flowing through each of the contact conductors 115 and the movable contact 130, the electromagnetic repulsive force causing each of the contact conductors 115 and the movable contact 130 to repel each other, increases contact pressure between the pair of contact portions 130a of the movable contact 130 and the fixed contacts 118a.

PRIOR ART DOCUMENT

Patent Document

Patent Document 1: Japanese Patent No. 5778989

SUMMARY OF THE INVENTION

Problems to be Solved by the Invention

However, since a current tends to flow through the shortest path, even when the contact conductors 115 have a C shape and an inverted C shape, the current Ip does not flow through portions W, adjacent to a connecting shaft 131, of upper plate portions 116 of the C shape and the inverted C shape and only flows through portions around both ends of the movable contact 130. As a result, an electromagnetic repulsive force is generated by the Lorentz force only around both the ends of the movable contact 130. Therefore, another electromagnetic repulsive force generated between the contact portions 130a of the movable contact 130 and the fixed contacts 118a may cause the contacts to come out of contact with each other.

In light of the above-described problems, it is an object of the present disclosure to provide an electromagnetic relay that prevents contacts from coming out of contact with each other due to an electromagnetic repulsive force generated between the contacts.

Means for Solving the Problem

An electromagnetic relay according to one aspect of the present disclosure includes a case, a first fixed contact terminal fixed to the case, the first fixed contact terminal extending outward from an inside of the case and including a first fixed contact, a second fixed contact terminal fixed to the case, the second fixed contact terminal extending outward from the inside of the case and including a second fixed contact, and a movable touch piece including, on one surface of the movable touch piece, a first movable contact and a second movable contact configured to respectively come into and out of contact with the first fixed contact of the first fixed contact terminal and the second fixed contact of the second fixed contact terminal in a contact-making and breaking direction that is a direction in which the first movable contact and the second movable contact respectively come into or out of contact with the first fixed contact and the second fixed contact, the movable touch piece being disposed in the case and configured to move in the contact-making and breaking direction. In such an electromagnetic relay, the first fixed contact terminal includes a facing portion disposed facing another surface of the movable touch piece located on an opposite side of the movable touch piece from the one surface in the contact-making and breaking direction, with a gap provided between the facing portion and the movable touch piece in the contact-making and breaking direction, the facing portion extends in a direction that intersects the contact-making and breaking direction and in which the first movable contact and the second movable contact of the movable touch piece are arranged, and at least part of the facing portion lies over the movable touch piece in plan view in the contact-making and breaking direction.

According to the electromagnetic relay according to the above aspect, in the respective regions of the facing portion of the first fixed contact terminal and the movable touch piece that lie over each other in plan view in the contact-making and breaking direction, a direction in which a current flows through the facing portion of the first fixed contact terminal extending in the direction that intersects the contact-making and breaking direction and in which the first movable contact and the second movable contact of the movable touch piece are arranged is opposite to a direction in which a current flows through the movable touch piece. As a result, a force that is applied to the movable touch piece to push the movable contacts to the fixed contacts is generated by the Lorentz force, and it is thus possible to increase contact pressure between the first movable contact of the movable touch piece and the first fixed contact, and contact pressure between the second movable contact of the movable touch piece and the second fixed contact. Therefore, an electromagnetic repulsive force derived from the Lorentz force can prevent the movable touch piece from coming out of contact with the first fixed contact terminal and the second fixed contact terminal. Further, it is possible for the electromagnetic relay having the above-described structure alone to increase the contact pressure between the movable contacts and the fixed contacts, which eliminates the need for consideration of design of peripheral components such as a bus bar.

Effect of the Invention

According to the present disclosure, it is possible to provide the electromagnetic relay capable of preventing contacts from coming out of contact with each other due to an electromagnetic repulsive force generated between contacts.

MODE FOR CARRYING OUT THE INVENTION

A description will be given below of an embodiment of the present disclosure with reference to the accompanying drawings. In the following description, terms representing specific directions or positions (for example, terms including "up", "down", "right", and "left") are used as necessary, and note that these terms are used to facilitate understanding of the disclosure with reference to the drawings, and the technical scope of the present disclosure is not limited by the meanings of these terms. Further, the following description will be given by way of example only in nature and is not intended to limit the present disclosure, entities to which the present disclosure is applied, or uses of the present disclosure. Furthermore, the drawings are schematic illustrations, and the ratios of dimensions and the like do not necessarily match the actual ratios.

(Application Example)

Figure 1:
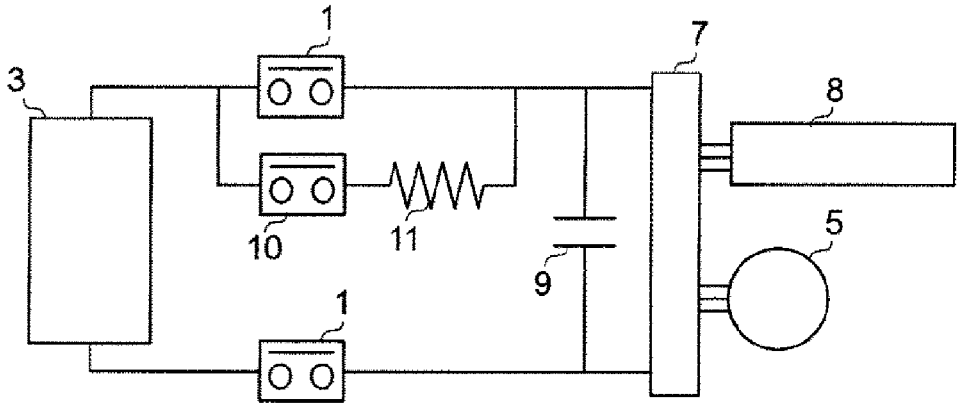
FIG. 1 is a circuit diagram schematically showing an example of an application case of an electromagnetic relay according to a first embodiment.

First, a description will be given of an example of a case where the present disclosure is applied with reference to FIG. 1. FIG. 1 is a circuit diagram schematically showing an example of an application case of an electromagnetic relay 1 according to the embodiment. As shown in FIG. 1, the electromagnetic relay 1 according to the embodiment is connected in between a battery 3 and a motor 5 of an electric vehicle, for example.

The battery 3 and the motor 5 are connected to each other through the electromagnetic relay 1 and an inverter 7. The motor 5 and a generator 8 are connected to the inverter 7. The electromagnetic relay 1 opens and closes a current path for power supply, the current path extending from the battery 3 to the motor 5 through the inverter 7. Further, the electromagnetic relay 1 opens and closes a current path for charging, the current path extending from the generator 8 to the battery 3 through the inverter 7.

A relay 10 for precharging and a resistor 11 are connected in between the battery 3 and the inverter 7 in parallel with the electromagnetic relay 1.

First Embodiment

Figure 2:
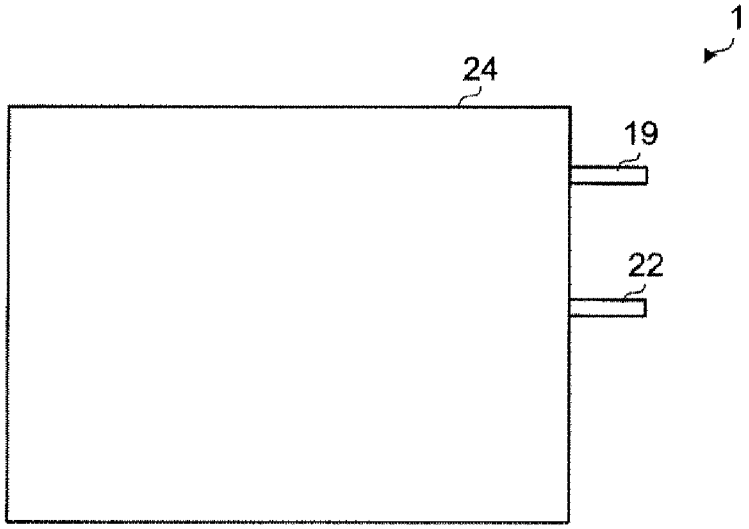
FIG. 2 is a front view schematically showing the electromagnetic relay according to the first embodiment.
Figure 3:
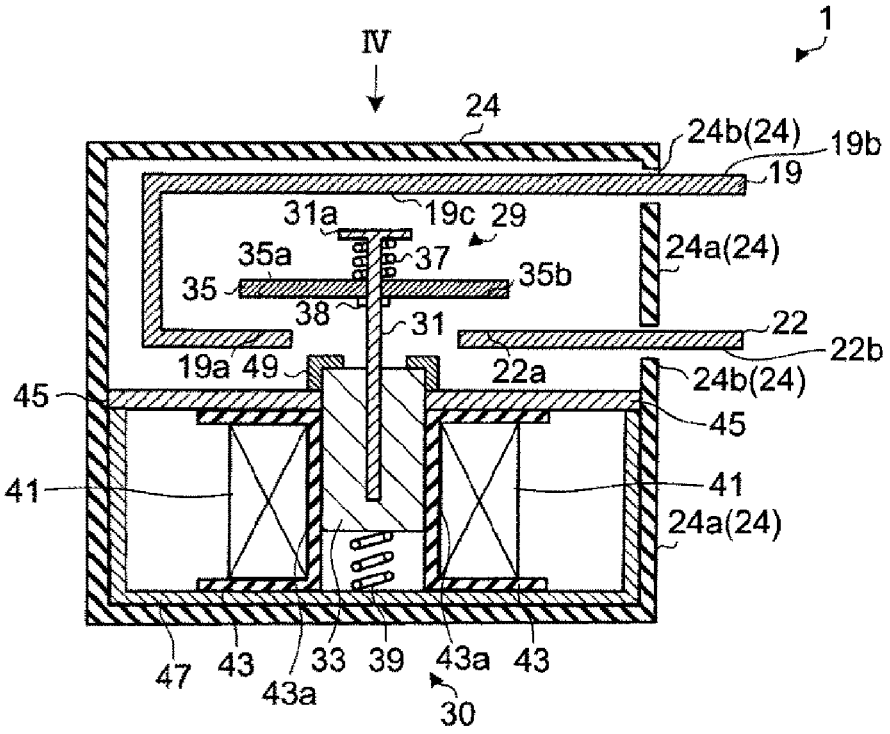
FIG. 3 is a front cross-sectional view schematically showing the electromagnetic relay in an open state.

A description will be given of the electromagnetic relay 1 according to a first embodiment of the present disclosure with reference to FIG. 2 and FIG. 3. FIG. 2 is a front view schematically showing the electromagnetic relay 1 according to the first embodiment. FIG. 3 is a front cross-sectional view schematically showing the electromagnetic relay 1 in an open state. In the following description, a direction in which a first movable contact 35*a* and a second movable contact 35*b* of a movable touch piece 35 come out of contact with a first fixed contact 19*a* and a second fixed contact 22*a* is defined as an upward direction, and a direction in which the first movable contact 35*a* and the second movable contact 35*b* come into contact with the first fixed contact 19*a* and the second fixed contact 22*a* is defined as a downward direction. A contact-making and breaking direction is a direction in which the first movable contact 35*a* and the second movable contact 35*b* come into or out of contact with the first fixed contact 19*a* and the second fixed contact 22*a*.

As shown in FIG. 2 and FIG. 3, the electromagnetic relay 1 includes a first fixed contact terminal 19 and a second fixed contact terminal 22, the movable touch piece 35, and a case 24 housing the first fixed contact terminal 19, the second fixed contact terminal 22, and the movable touch piece 35. The first fixed contact terminal 19 and the second fixed contact terminal 22 are fixed to the case 24 and are arranged apart from each other. The case 24 has, for example, a substantially square box shape and is made of an insulating resin.

As shown in FIG. 3, the first fixed contact terminal 19 and the second fixed contact terminal 22 extend outward from the inside of the case 24, and protrude, in a direction intersecting the contact-making and breaking direction, through openings 24*b* provided on an outer surface 24*a* of the case 24. The first fixed contact terminal 19 includes a connection end 19*b* on one end of the first fixed contact terminal 19 located outside the case 24 in the direction intersecting the contact-making and breaking direction, the connection end 19*b* being connected to a bus bar. The second fixed contact terminal 22 includes a connection end 22*b* on one end of the second fixed contact terminal 22 located outside the case 24 in the direction intersecting the contact-making and breaking direction, the connection end 22*b* being connected to a bus bar.

The connection end 19*b* of the first fixed contact terminal 19 and the connection end 22*b* of the second fixed contact terminal 22 are arranged side by side outside the case 24 in a direction intersecting a longitudinal axis of the movable touch piece 35. The first fixed contact terminal 19 has a J shape that is inverted and laid down sideways. The first fixed contact terminal 19 includes the first fixed contact 19*a* on the other end of the first fixed contact terminal 19 located inside the case 24, the first fixed contact 19*a* being configured to come into and out of contact with the first movable contact 35*a* of the movable touch piece 35. Further, the second fixed contact terminal 22 includes the second fixed contact 22*a* on the other end of the second fixed contact terminal 22 located inside the case 24, the second fixed contact 22*a* being configured to come into and out of contact with the second movable contact 35*b* of the movable touch piece 35. The movable touch piece 35 is disposed between the other end of the first fixed contact terminal 19 and the other end of the second fixed contact terminal 22 in the case 24 and is configured to move in the contact-making and breaking direction.

The first fixed contact terminal 19 and the second fixed contact terminal 22 are made of metal, for example, and have a flat plate shape. The first fixed contact terminal 19 includes a facing portion 19*c* fixedly disposed facing an upper surface of the movable touch piece 35 on an opposite side from a lower surface of the movable touch piece 35 in the contact-making and breaking direction, with a gap provided between the facing portion 19*c* and the movable touch piece 35 in the contact-making and breaking direction.

The electromagnetic relay 1 further includes a contact mechanism unit 29 and an electromagnet unit 30 in the case 24.

The contact mechanism unit 29 includes a movable shaft 31 extending in parallel with the contact-making and breaking direction, a movable iron core 33 coupled to a lower portion of the movable shaft 31, the movable touch piece 35 through which the movable shaft 31 extends, a contact spring 37 that pushes the movable touch piece 35 toward a contact position (that is, downward) in the contact-making and breaking direction, a ring 38 that stops the movable touch piece 35 from moving downward, and a return spring 39 that pushes the movable iron core 33 upward.

The movable shaft 31 includes an upper portion passing through the movable touch piece 35 and a lower portion fixed to the movable iron core 33. The lower portion of the movable shaft 31 is inserted and supported in the electromagnet unit 30 together with the movable iron core 33, and the movable shaft 31 is configured to reciprocate along an axis of the movable shaft 31 parallel with the contact-making and breaking direction. The movable shaft 31 include a disk-shaped guard portion 31*a* at an upper end of the movable shaft 31. The contact spring 37 is provided between the disk-shaped guard portion 31*a* and the movable touch piece 35 and pushes the movable touch piece 35 toward the contact position in the contact-making and breaking direction.

The movable touch piece 35 is made of metal, for example, and has a flat plate shape. The movable touch piece 35 is disposed in the case 24 and is configured to move in the contact-making and breaking direction. The movable touch piece 35 includes the first movable contact 35*a* and the second movable contact 35*b* on a surface facing the electromagnet unit 30 in the direction in which the axis of the movable shaft 31 extends (that is, the lower surface), the first movable contact 35*a* and the second movable contact 35*b* being configured to come into and out of contact with the first fixed contact 19*a* and the second fixed contact 22*a* in the contact-making and breaking direction. The first movable contact 35*a* faces the first fixed contact 19*a* of the first fixed contact terminal 19 and is configured to come into and out of contact with the first fixed contact 19*a*. Further, the second movable contact 35*b* faces the second fixed contact 22*a* of the second fixed contact terminal 22 and is configured to come into and out of contact with the second fixed contact 22*a*.

A lower end of the movable iron core 33 is supported by the return spring 39. When the electromagnet unit 30 has not been energized, the movable iron core 33 is pushed upward by a pushing force of the return spring 39, and when the electromagnet unit 30 has been energized, the movable iron core 33 is pulled downward against the pushing force of the return spring 39.

The electromagnet unit 30 includes a coil 41, a spool 43 having insulation properties, a first yoke 45, a second yoke 47 having a U shape, and a stopper 49. The coil 41 is wound around a body 43*a* of the spool 43. The first yoke 45 is fixed between upper ends serving as open ends of the second yoke 47. The stopper 49 is disposed on an upper portion of the first yoke 45 and restricts upward movement of the movable iron core 33.

Figure 4:
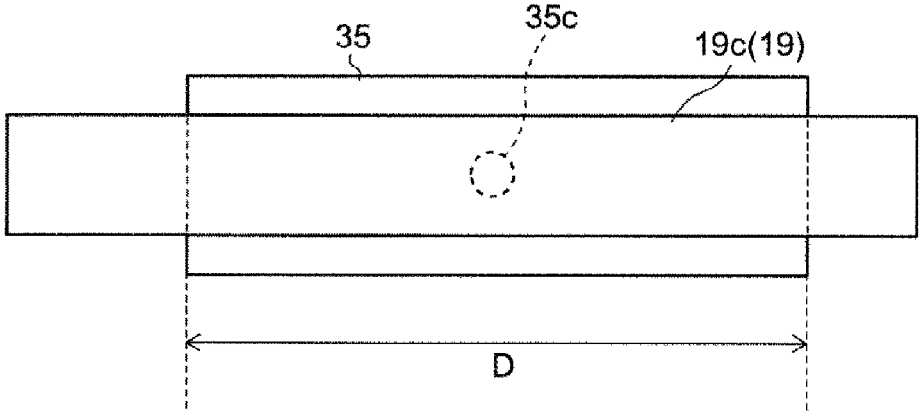
FIG. 4 is a plan view of FIG. 3 in a direction IV.

Reference is now made to FIG. 4. FIG. 4 is a plan view as viewed from above the facing portion 19*c* of the first fixed contact terminal 19 and the movable touch piece 35 in the contact-making and breaking direction. Note that, in FIG. 4, the contact mechanism unit 29 is not illustrated in order to facilitate understanding of the positional relation between the movable touch piece 35 and the facing portion 19*c* of the first fixed contact terminal 19.

The facing portion 19*c* of the first fixed contact terminal 19 extends, in plan view in the contact-making and breaking direction, facing a center portion 35*c* of the movable touch piece 35 in a direction in which the first movable contact 35*a* and the second movable contact 35*b* are arranged. Further, the facing portion 19*c* lies over, in plan view in the contact-making and breaking direction, a whole of the movable touch piece 35 in the direction in which the first movable contact 35*a* and the second movable contact 35*b* are arranged. Further, the facing portion 19*c* is disposed in parallel with the movable touch piece 35 in side view and includes a section D to be described later. In FIG. 4, the facing portion 19*c* is smaller in width than the movable touch piece 35, but the facing portion 19*c* may be equal to or larger than the movable touch piece 35 in width.

Next, a description will be given of an operation of the electromagnetic relay 1 having the above-described structure. First, as shown in FIG. 3, when no voltage is applied to the coil 41, the movable iron core 33 is pushed upward by a spring force of the return spring 39. This causes the movable shaft 31 integral with the movable iron core 33 to be pushed upward, and the movable touch piece 35 is pushed upward accordingly. This in turn brings about the open state where the first movable contact 35*a* and the second movable contact 35*b* of the movable touch piece 35 are out of contact with the first fixed contact 19*a* of the first fixed contact terminal 19 and the second fixed contact 22*a* of the second fixed contact terminal 22.

Figure 5:
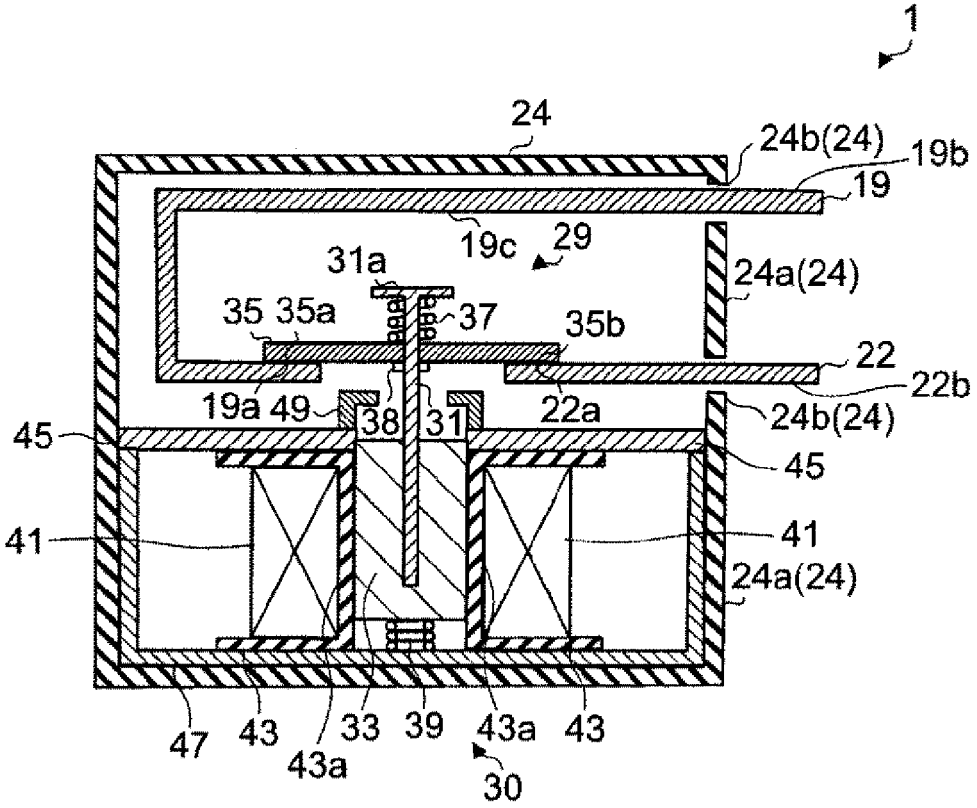
FIG. 5 is a front cross-sectional view schematically showing the electromagnetic relay in a closed state.
Figure 6:
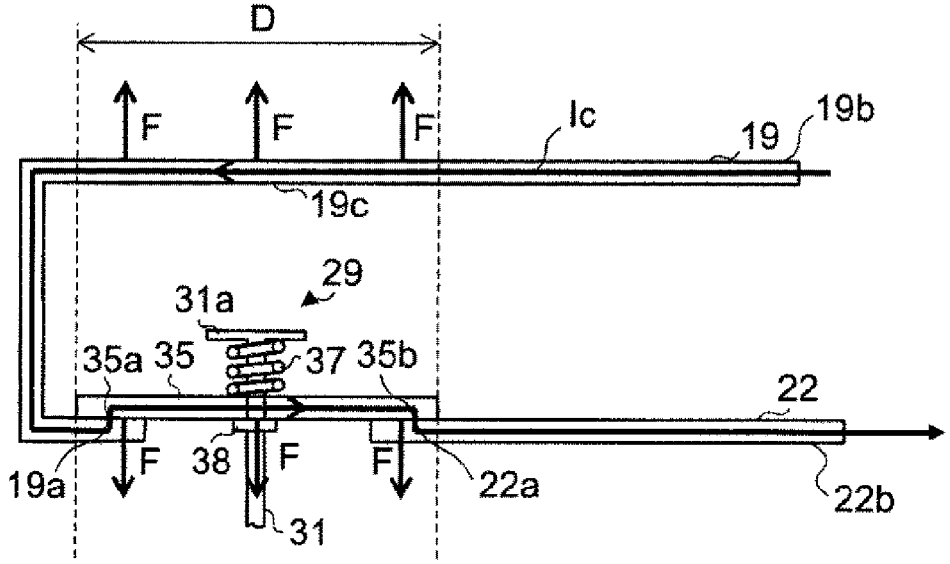
FIG. 6 is an explanatory diagram showing a direction of current flowing through the electromagnetic relay in a closed state.

Next, when the electromagnet unit 30 is energized by a current flowing through the coil 41, the movable iron core 33, the movable shaft 31, and the movable touch piece 35 slide downward against the spring force of the return spring 39 as shown in FIG. 5. This brings about the closed state where the first movable contact 35*a* and the second movable contact 35*b* are in contact with the first fixed contact 19*a* and the second fixed contact 22*a*. In this closed state, as shown in FIG. 6, a current flows from the connection end 19*b* of the first fixed contact terminal 19 connected to the battery 3 to the connection end 22*b* of the second fixed contact terminal 22 through the movable touch piece 35 and the second fixed contact terminal 22.

The facing portion 19*c* of the first fixed contact terminal 19 is disposed facing the other surface (upper surface) located on the opposite side of the movable touch piece 35, in the contact-making and breaking direction, from the surface (lower surface) having the first movable contact 35*a* and the second movable contact 35*b*, with a gap provided between the facing portion 19*c* and the movable touch piece 35. Further, the facing portion 19*c* of the first fixed contact terminal 19 extends in a direction that intersects the contact-making and breaking direction and in which the first movable contact 35*a* and the second movable contact 35*b* of the movable touch piece 35 are arranged. Therefore, for example, when a current Ic flows from the first fixed contact terminal 19 toward the second fixed contact terminal 22, the section D is generated where, in respective regions of the facing portion 19*c* of the first fixed contact terminal 19 and the movable touch piece 35 that lie over each other in plan view in the contact-making and breaking direction, a direction in which the current Ic flows through the facing portion 19*c* of the first fixed contact terminal 19 extending above the movable touch piece 35 is opposite to a direction in which the current Ic flows through the movable touch piece 35. In this section D, the Lorentz force generates an electromagnetic repulsive force F that causes the facing portion 19*c* of the first fixed contact terminal 19 and the movable touch piece 35 to repel each other in the contact-making and breaking direction. This in turn causes the electromagnetic repulsive force F to push the movable touch piece 35 against the first fixed contact 19*a* of the first fixed contact terminal 19 and the second fixed contact 22*a* of the second fixed contact terminal 22. This makes it possible to increase contact pressure between the first movable contact 35*a* and the second movable contact 35*b*, and the first fixed contact 19*a* and the second fixed contact 22*a* with the help of the electromagnetic repulsive force F, which in turn makes it possible to increase contact reliability. It is further possible to prevent the movable touch piece 35 from coming out of contact with the first fixed contact terminal 19 and the second fixed contact terminal 22.

Note that at least part of the facing portion 19*c* of the first fixed contact terminal 19 may lie over the movable touch piece 35 in plan view in the contact-making and breaking direction, and the electromagnetic repulsive force F is generated in each of the regions lying over each other. The larger the regions where the facing portion 19*c* of the first fixed contact terminal 19 and the movable touch piece 35 lie over each other in plan view in the contact-making and breaking direction is, the larger the Lorentz force becomes. Further, since the Lorentz force is proportional to the square of a value of the current, the larger the value of the current flowing through the movable touch piece 35 is, the larger the contact pressure applied from the first movable contact 35*a* and the second movable contact 35*b* to the first fixed contact 19*a* and the second fixed contact 22*a* becomes. This in turn makes it possible to prevent the contacts from coming out of contact with each other.

Further, the facing portion 19*c* of the first fixed contact terminal 19 extends, in plan view in the contact-making and breaking direction, facing the center portion 35*c* of the movable touch piece 35 in direction in which the tow movable contacts 35*a* and 35*b*, the first movable contact 35*a* and the second movable contact 35*b*, are arranged. This makes it possible to push, when the current flows in the closed state, the center portion 35*c* of the movable touch piece 35 downward, which in turn makes it possible for the first movable contact 35*a* and the second movable contact 35*b* located at both ends of the movable touch piece 35 to evenly come into contact with the two fixed contacts of the first fixed contact terminal 19 and the second fixed contact terminal 22. Further, since the facing portion 19*c* of the first fixed contact terminal 19 is disposed in parallel with the movable touch piece 35 in plan view in the contact-making and breaking direction, it is possible to cause the electromagnetic repulsive force F generated by the Lorentz force to be evenly applied to the movable touch piece 35.

Further, the facing portion 19*c* of the first fixed contact terminal 19 lies over, in plan view in the contact-making and breaking direction, the whole of the movable touch piece 35 in the direction in which the two movable contacts, the first movable contact 35*a* and the second movable contact 35*b*, are arranged. This applies a downward force to the whole of the movable touch piece 35, making it possible to prevent the movable touch piece 35 from coming out of contact with the first fixed contact 19*a* of the first fixed contact terminal 19 and the second fixed contact 22*a* of the second fixed contact terminal 22.

Second Embodiment

Figure 7:
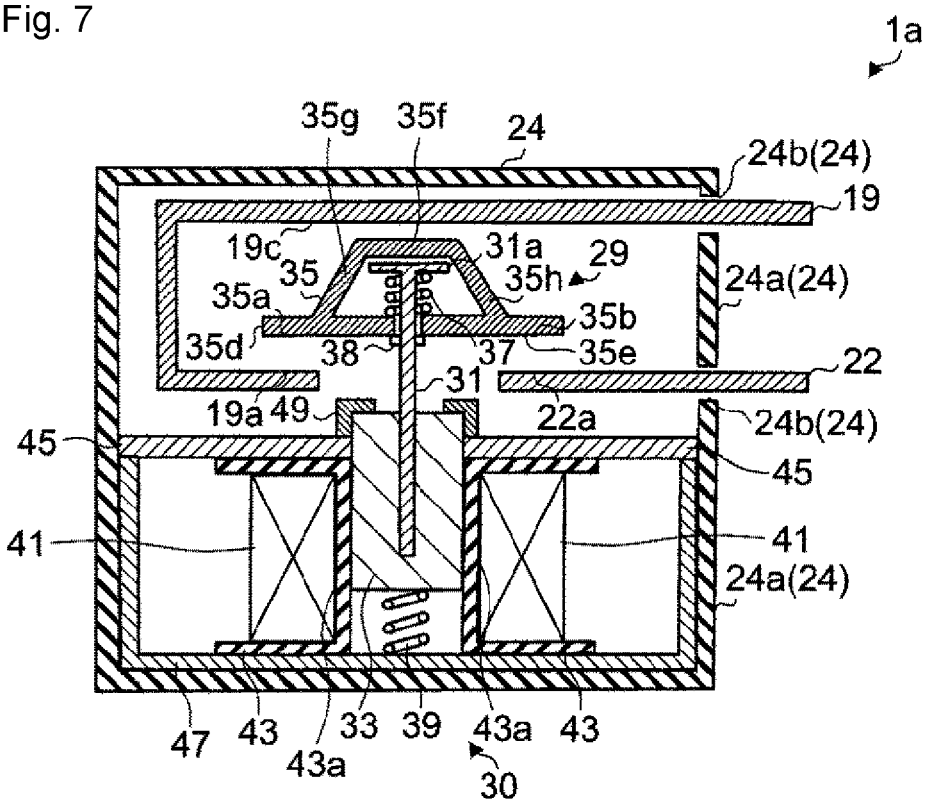
FIG. 7 is a front cross-sectional view schematically showing an electromagnetic relay in an open state according to a second embodiment.
Figure 8:
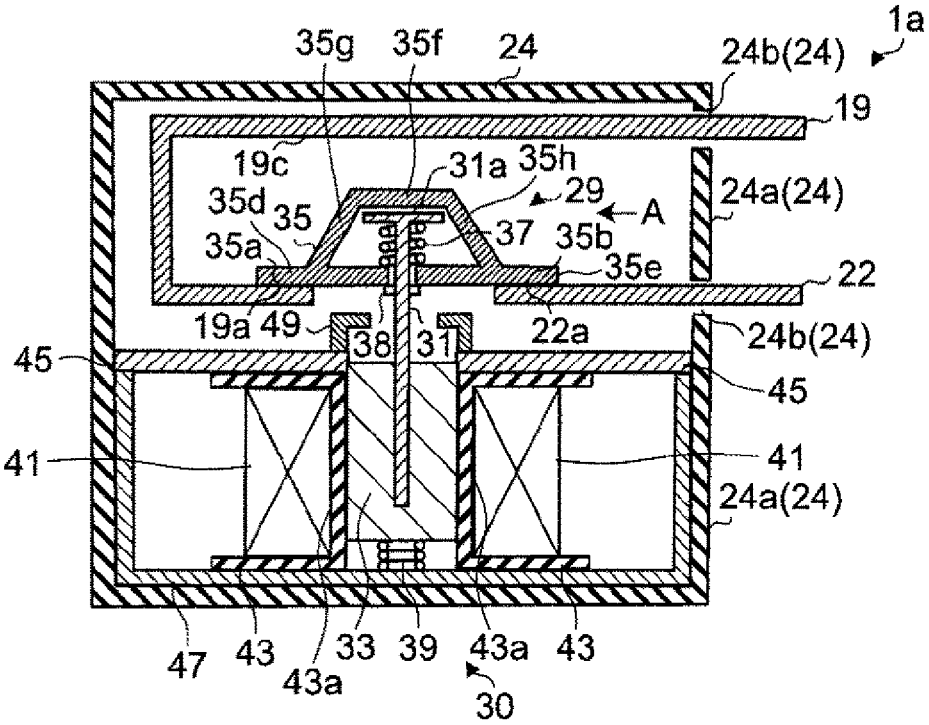
FIG. 8 is a front cross-sectional view schematically showing the electromagnetic relay in a closed state.
Figure 9:
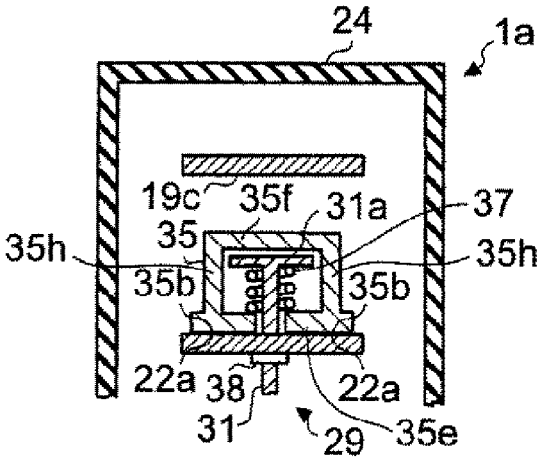
FIG. 9 is a partial side view of the electromagnetic relay.

Next, a description will be given of an electromagnetic relay 1*a* according to a second embodiment of the present disclosure with reference to FIG. 7 to FIG. 9. FIG. 7 is a front cross-sectional view schematically showing the electromagnetic relay 1*a* in an open state according to the second embodiment. FIG. 8 is a front cross-sectional view schematically showing the electromagnetic relay in a closed state. FIG. 9 is a partial side view of the electromagnetic relay. The movable touch piece 35 of the electromagnetic relay 1 of the first embodiment is disposed below the contact spring 37, whereas the movable touch piece 35 of the electromagnetic relay 1*a* of the second embodiment is partially disposed above a contact spring 37. Note that the electromagnetic relay 1*a* according to the second embodiment is identical to the electromagnetic relay 1 according to the first embodiment in structure other than features to be described below.

The movable touch piece 35 according to the second embodiment includes a first lower plate 35*d* including the first movable contact 35*a*, a second lower plate 35*e* including the second movable contact 35*b*, an upper plate 35*f* disposed above the movable shaft 31, a first intermediate plate 35*g* extending from one end of the upper plate 35*f* to an upper surface of the first lower plate 35*d*, and a second intermediate plate 35*h* extending from the other end of the upper plate 35*f* to an upper surface of the second lower plate 35*e*. The first intermediate plate 35*g*, the upper plate 35*f*, and the second intermediate plate 35*h* form an arch shape and surround the contact spring 37. As shown in FIG. 9, the first intermediate plate 35*g* and the second intermediate plate 35*h* have holes provided through their respective centers, but may be flat plates without holes.

As shown in FIG. 7 and FIG. 8, the upper plate 35*f* is disposed facing the facing portion 19*c* of the first fixed contact terminal 19, the upper plate 35*f* extending through between the contact spring 37 disposed away from, farther than a lower surface of the movable touch piece 35, a contact position and the facing portion 19*c* of the first fixed contact terminal 19. The first lower plate 35*d* and the second lower plate 35*e* have a slit therebetween. Accordingly, the movable touch piece 35 has a current path extending from the first movable contact 35*a* of the first lower plate 35*d* to the second movable contact 35*b* of the second lower plate 35*e* through the first intermediate plate 35*g*, the upper plate 35*f*, and the second intermediate plate 35*h*.

The contact spring 37 that pushes the movable touch piece 35 toward one surface along the movable shaft 31 is disposed between an upper end of the movable shaft 31 and the movable touch piece 35. The movable touch piece 35 has the current path extending from the first movable contact 35*a* to the second movable contact 35*b* through between the contact spring 37 and the facing portion 19*c* of the first fixed contact terminal 19, and the current path lies over a current path through the facing portion 19*c* of the first fixed contact terminal 19 in plan view in the contact-making and breaking direction.

Since the upper plate 35*f* that is part of the movable touch piece 35 is disposed above the movable shaft 31, it is possible to arrange the facing portion 19*c* of the first fixed contact terminal 19 and the upper plate 35*f* of the movable touch piece 35 in proximity to each other. That is, a distance between the facing portion 19*c* and the movable touch piece 35 can be reduced by the sum of a length of the contact spring 37 and a length of the disk-shaped guard portion 31*a* of the movable shaft 31. As a result, a larger electromagnetic repulsive force F derived from the Lorentz force can be applied to the upper plate 35*f* of the movable touch piece 35.

Third Embodiment

Figure 10:
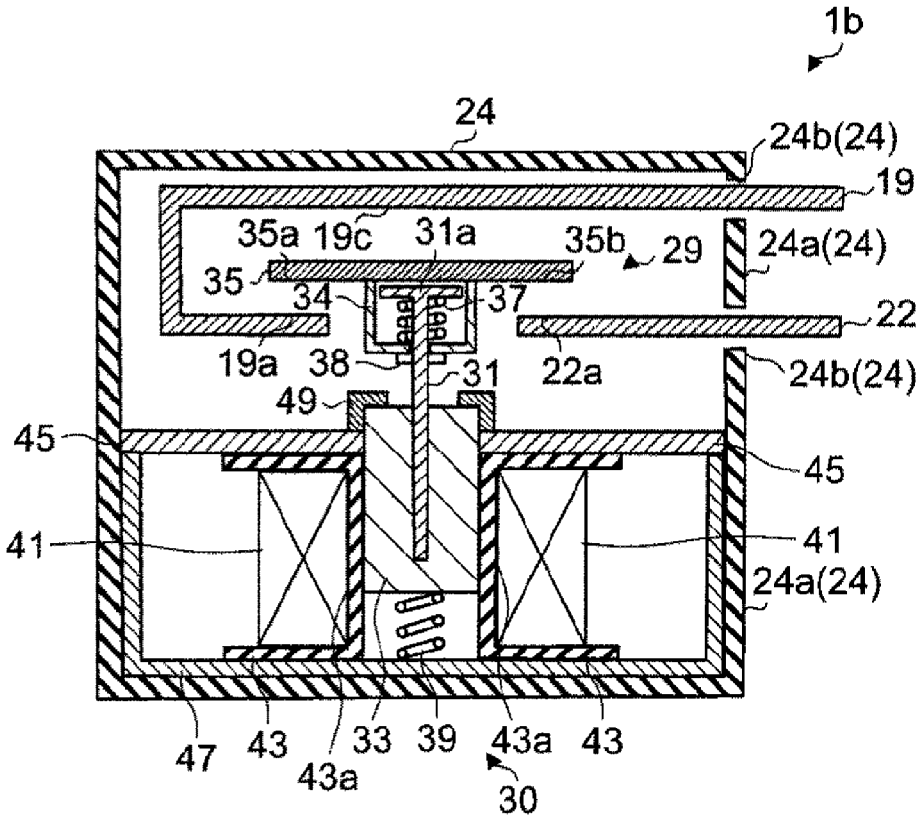
FIG. 10 is a front cross-sectional view schematically showing an electromagnetic relay in an open state according to a third embodiment.
Figure 11:
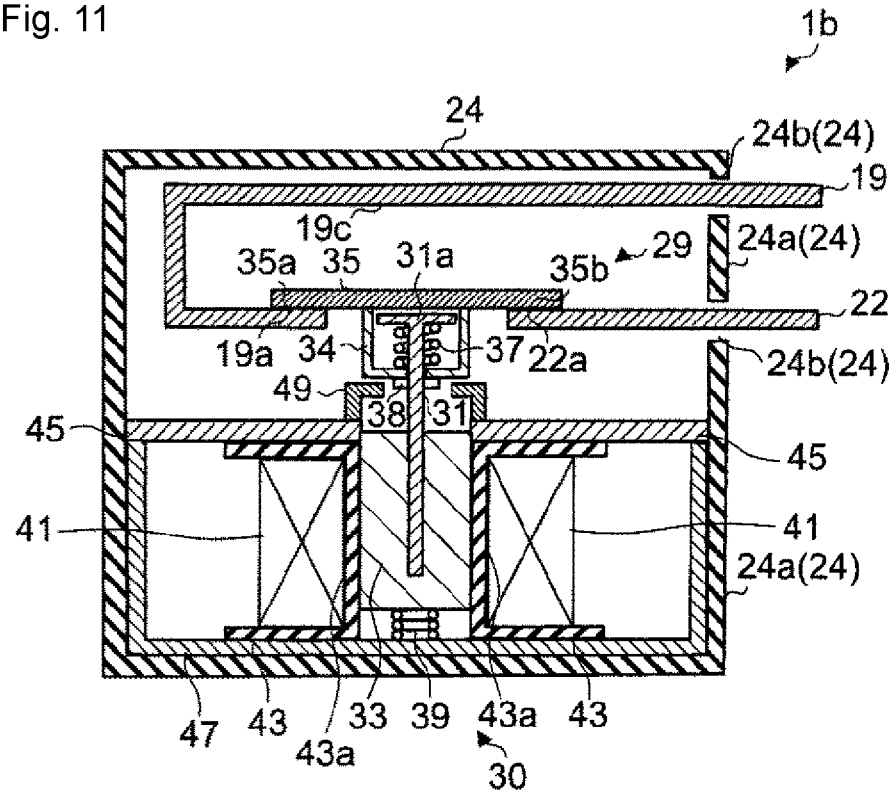
FIG. 11 is a front cross-sectional view schematically showing the electromagnetic relay in a closed state.

Next, a description will be given of an electromagnetic relay 1*b* according to a third embodiment of the present disclosure with reference to FIG. 10 and FIG. 11. FIG. 10 is a front cross-sectional view schematically showing the electromagnetic relay 1*b* in an open state according to the third embodiment. FIG. 11 is a front cross-sectional view schematically showing the electromagnetic relay 1*b* in a closed state. The contact spring 37 according to the first embodiment is disposed above the movable touch piece 35, whereas the contact spring 37 according to the third embodiment is disposed below the movable touch piece 35. Note that the electromagnetic relay 1*b* according to the third embodiment is identical to the electromagnetic relay 1 according to the first embodiment in structure other than features to be described below.

The contact mechanism unit 29 according to the third embodiment includes a hook 34 that is held between a lower end of the contact spring 37 and the ring 38 and transmits, to the movable touch piece 35, a pushing force of the contact spring 37 toward the contact position in the contact-making and breaking direction. One end of the hook 34 is held between the lower end of the contact spring 37 and the ring 38, and the other end of the hook 34 is fixed to a lower surface of the movable touch piece 35. The movable touch piece 35 is supported on the movable shaft 31 with the hook 34.

Disposing the contact spring 37 below the movable touch piece 35 with the hook 34 allows the facing portion 19*c* of the first fixed contact terminal 19 and the movable touch piece 35 to be arranged in proximity to each other. That is, the distance between the facing portion 19*c* and the movable touch piece 35 can be reduced by the sum of a length of the contact spring 37 and a length of the disk-shaped guard portion 31*a* of the movable shaft 31. As a result, a larger electromagnetic repulsive force F derived from the Lorentz force can be applied to the movable touch piece 35.

Note that the third embodiment may have a structure without the ring 38. In this structure, the disk-shaped guard portion 31*a* is in contact with the movable touch piece 35, and the contact spring 37 is held between the disk-shaped guard portion 31*a* and the hook 34.

Fourth Embodiment

Figure 12:
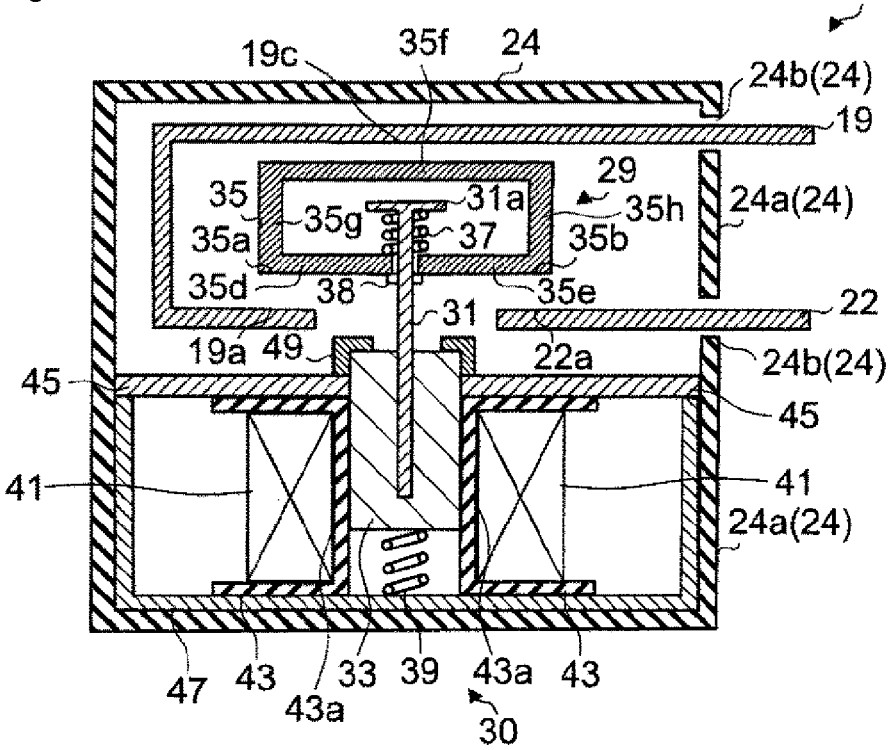
FIG. 12 is a front cross-sectional view schematically showing an electromagnetic relay in an open state according to a fourth embodiment.
Figure 13:
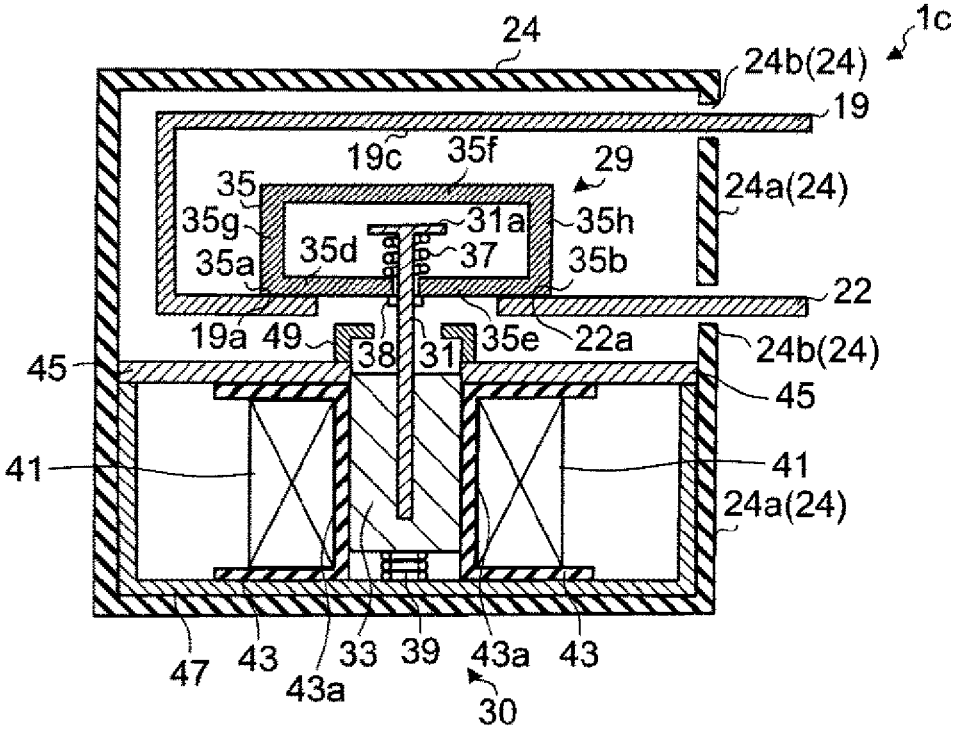
FIG. 13 is a front cross-sectional view schematically showing the electromagnetic relay in a closed state.

Next, a description will be given of an electromagnetic relay 1*c* according to a fourth embodiment of the present disclosure with reference to FIG. 12 and FIG. 13. FIG. 12 is a front cross-sectional view schematically showing an electromagnetic relay 1*c* in an open state according to the fourth embodiment. FIG. 13 is a front cross-sectional view schematically showing the electromagnetic relay 1*c* in a closed state. The movable touch piece 35 according to the second embodiment has an arch shape, whereas the movable touch piece 35 according to the fourth embodiment has a box shape. Note that the electromagnetic relay 1*c* according to the fourth embodiment is identical to the electromagnetic relay 1*a* according to the second embodiment in structure other than features to be described below.

As shown in FIG. 12 and FIG. 13, the first intermediate plate 35*g* extends from the first lower plate 35*d* along the axis of the movable shaft 31. Further, the second intermediate plate 35*h* extends from the second lower plate 35*e* along the axis of the movable shaft 31. Further, respective ends of the first lower plate 35*d* and the second lower plate 35*e* are held between the contact spring 37 and the ring 38 with an insulator interposed between the ends, and the contact spring 37 and the ring 38. It is easier to machine the movable touch piece 35 having a box shape than the movable touch piece 35 having an arch shape.

The movable touch piece 35 having a box shape allows the facing portion 19*c* of the first fixed contact terminal 19 and the upper plate 35*f* of the movable touch piece 35 to be arranged in proximity to each other. That is, the movable touch piece 35 can further approach the facing portion 19*c* by a height of the upper plate 35*f*. As a result, a larger electromagnetic repulsive force F derived from the Lorentz force can be applied to the upper plate 35*f* of the movable touch piece 35.

Note that the fourth embodiment may have a structure without the ring 38. In this structure, the disk-shaped guard portion 31*a* is in contact with the upper plate 35*f* of the movable touch piece 35, and the contact spring 37 is held between the disk-shaped guard portion 31*a* and each of the first lower plate 35*d* and the second lower plate 35*e* of the movable touch piece 35.

Fifth Embodiment

Figure 14:
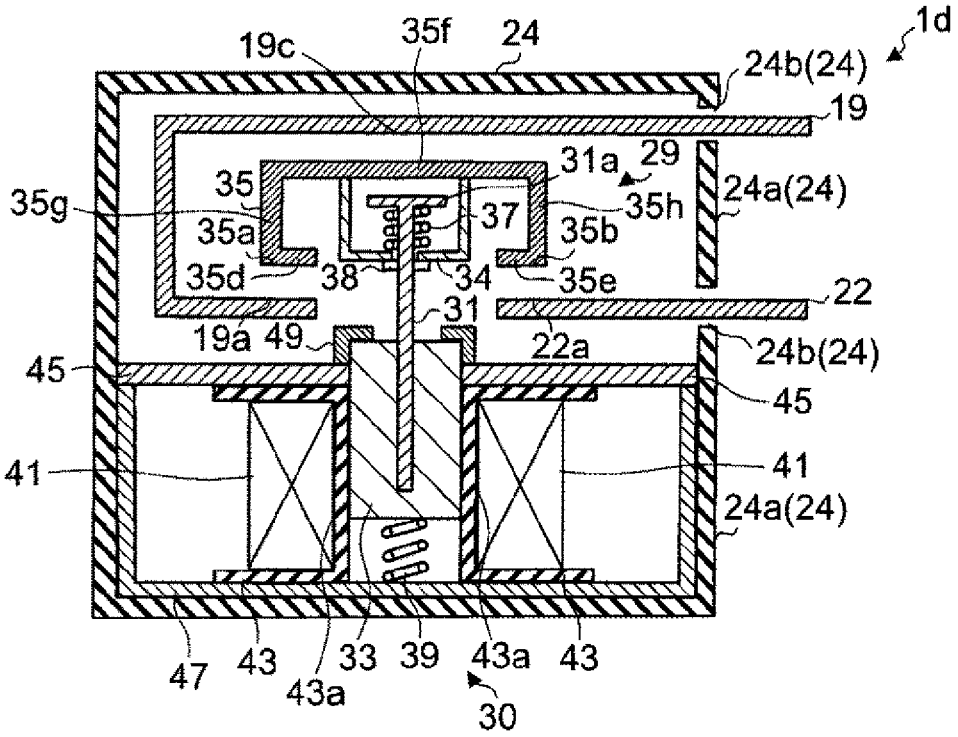
FIG. 14 is a front cross-sectional view schematically showing an electromagnetic relay in an open state according to a fifth embodiment.
Figure 15:
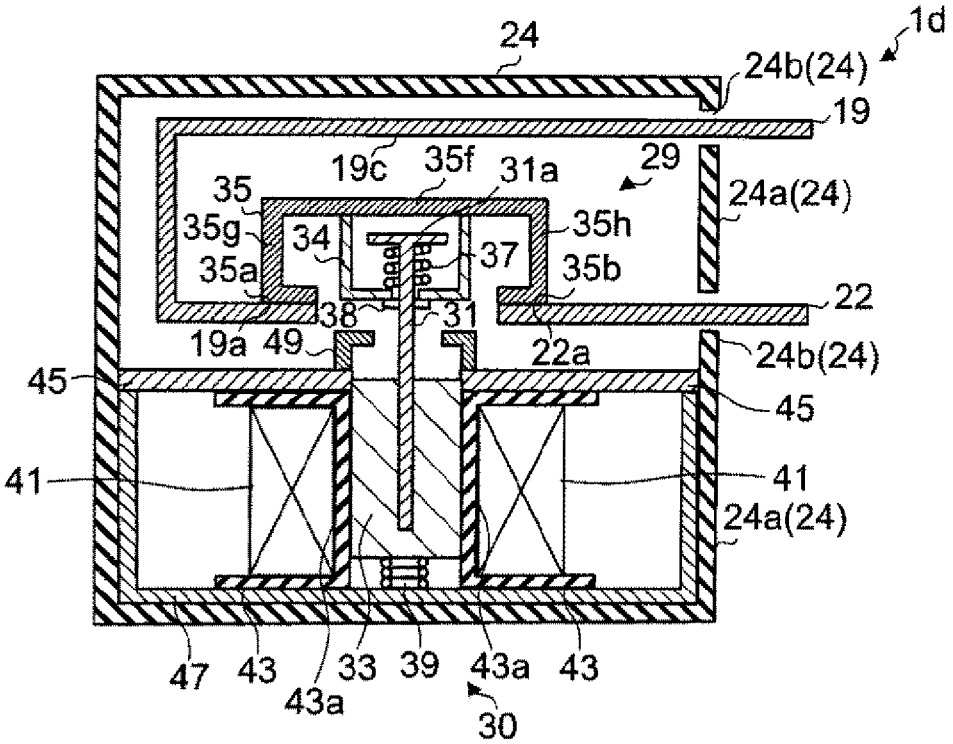
FIG. 15 is a front cross-sectional view schematically showing the electromagnetic relay in a closed state.

Next, a description will be given of an electromagnetic relay 1*d* according to a fifth embodiment of the present disclosure with reference to FIG. 14 and FIG. 15. FIG. 14 is a front cross-sectional view schematically showing an electromagnetic relay 1*d* in an open state according to the fifth embodiment. FIG. 15 is a front cross-sectional view schematically showing the electromagnetic relay 1*d* in a closed state. The electromagnetic relay 1*d* according to the fifth embodiment corresponds to a combination of the contact mechanism unit 29 of the third embodiment and the contact mechanism unit 29 of the fourth embodiment. Note that the electromagnetic relay 1*d* according to the fifth embodiment is identical to the electromagnetic relay 1*b* according to the third embodiment in structure other than features to be described below.

The contact mechanism unit 29 according to the fifth embodiment includes the hook 34 that is held between the lower end of the contact spring 37 and the ring 38 and transmits, to the movable touch piece 35, the pushing force of the contact spring 37 toward the contact position. One end of the hook 34 is held between the lower end of the contact spring 37 and the ring 38, and the other end of the hook 34 is fixed to the lower surface of the upper plate 35*f* of the movable touch piece 35. The movable touch piece 35 is supported on the movable shaft 31 with the hook 34.

This structure allows the facing portion 19*c* of the first fixed contact terminal 19 and the upper plate 35*f* of the movable touch piece 35 to be arranged in proximity to each other. That is, the movable touch piece 35 can further approach the facing portion 19*c* by a height of the upper plate 35*f*. As a result, a larger electromagnetic repulsive force F derived from the Lorentz force can be applied to the upper plate 35*f* of the movable touch piece 35.

Sixth Embodiment

Figure 16:
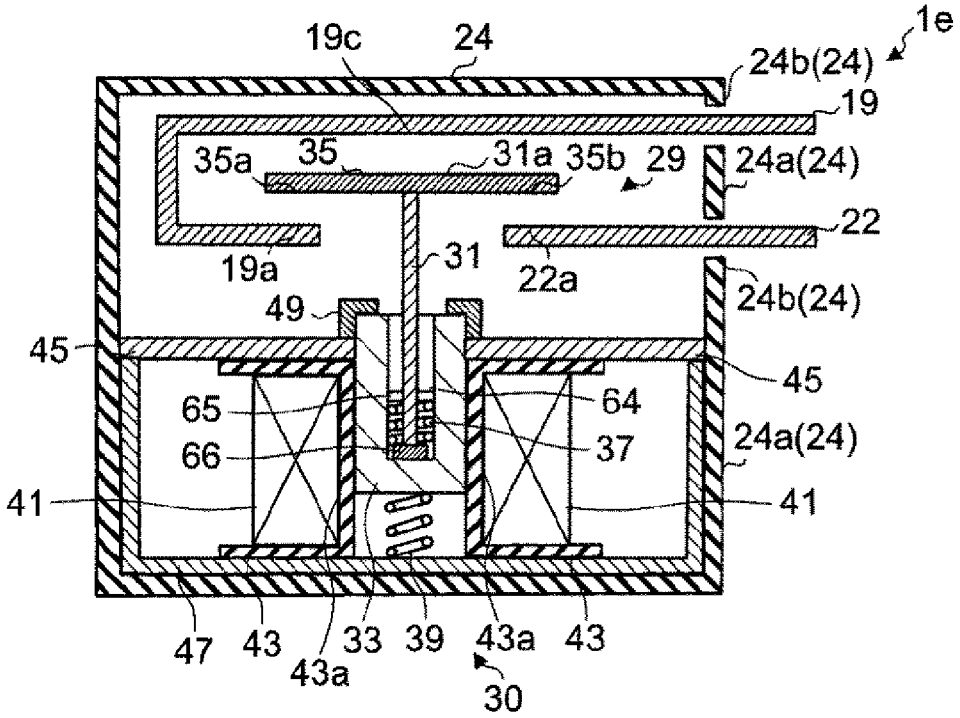
FIG. 16 is a front cross-sectional view schematically showing an electromagnetic relay in an open state according to a sixth embodiment.
Figure 17:
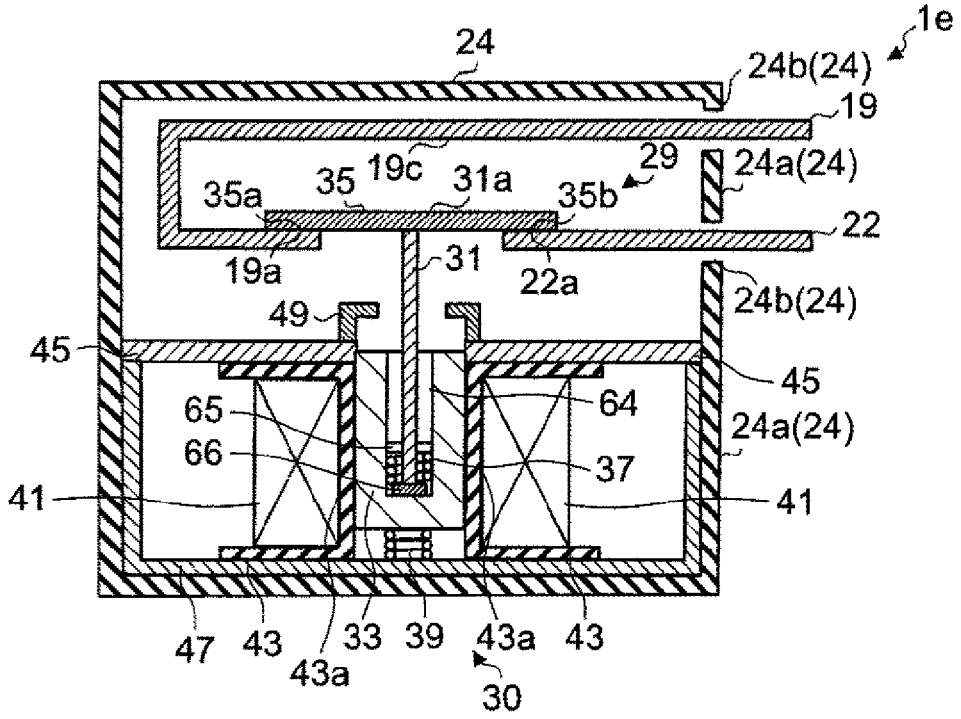
FIG. 17 is a front cross-sectional view schematically showing the electromagnetic relay in a closed state.

Next, a description will be given of an electromagnetic relay 1*e* according to a sixth embodiment of the present disclosure with reference to FIG. 16 and FIG. 17. FIG. 16 is a front cross-sectional view schematically showing an electromagnetic relay 1*e* in an open state according to the sixth embodiment. FIG. 17 is a front cross-sectional view schematically showing the electromagnetic relay 1*e* in a closed state. In the electromagnetic relay 1 according to the first embodiment, the contact spring 37 that pushes the movable touch piece 35 downward is provided on a side of the movable touch piece 35 remote from the movable iron core 33. On the other hand, in the electromagnetic relay 1*e* according to the sixth embodiment, the contact spring 37 is provided in the movable iron core 33. Note that the electromagnetic relay 1*e* according to the sixth embodiment is identical to the electromagnetic relay 1 according to the first embodiment in structure other than features to be described below.

The movable iron core 33 according to the sixth embodiment includes a hollow hole 64 that results from hollowing out a portion of the movable iron core 33 where the movable shaft 31 is inserted. The contact spring 37 is inserted in the hollow hole 64. On a side of the contact spring 37 adjacent to the movable touch piece 35, a ring 65 is disposed in the hollow hole 64. The contact spring 37 is disposed between the ring 65 and a ring 66 in a state where the contact spring 37 keeps pushing the movable shaft 31 to cause the contacts to approach each other in a contact-opening and breaking direction. The upper end of the movable shaft 31 is fixed to the lower surface of the movable touch piece 35.

The ring 65 is fixed to the movable iron core 33 and has a through hole, and the movable shaft 31 slides through the through hole. The ring 66 is fixed to the lower end of the movable shaft 31. The ring 66 is held between the lower end of the contact spring 37 and a bottom surface of the hollow hole 64 of the movable iron core 33.

When the electromagnet unit 30 is energized by a current flowing through the coil 41, the contact mechanism unit 29 slides downward against the spring force of the return spring 39. This brings about the closed state where the first movable contact 35*a* and the second movable contact 35*b* are in contact with the first fixed contact 19*a* and the second fixed contact 22*a*, respectively. After being brought into the closed state, the movable iron core 33 and the ring 65 further move downward to compress the contact spring 37 to maintain contact pressure between the first movable contact 35*a* and the first fixed contact 19*a* and contact pressure between the second movable contact 35*b* and the second fixed contact 22*a*.

Since the contact spring 37 is not disposed on the upper side of the movable touch piece 35, and the disk-shaped guard portion 31*a* is not provided at the upper end of the movable shaft 31, it is possible to further reduce the distance between the facing portion 19*c* of the first fixed contact terminal 19 and the movable touch piece 35, which in turn makes it possible to increase the electromagnetic repulsive force F that is generated by the Lorentz force and is applied to the movable touch piece 35.

Seventh Embodiment

Figure 18:
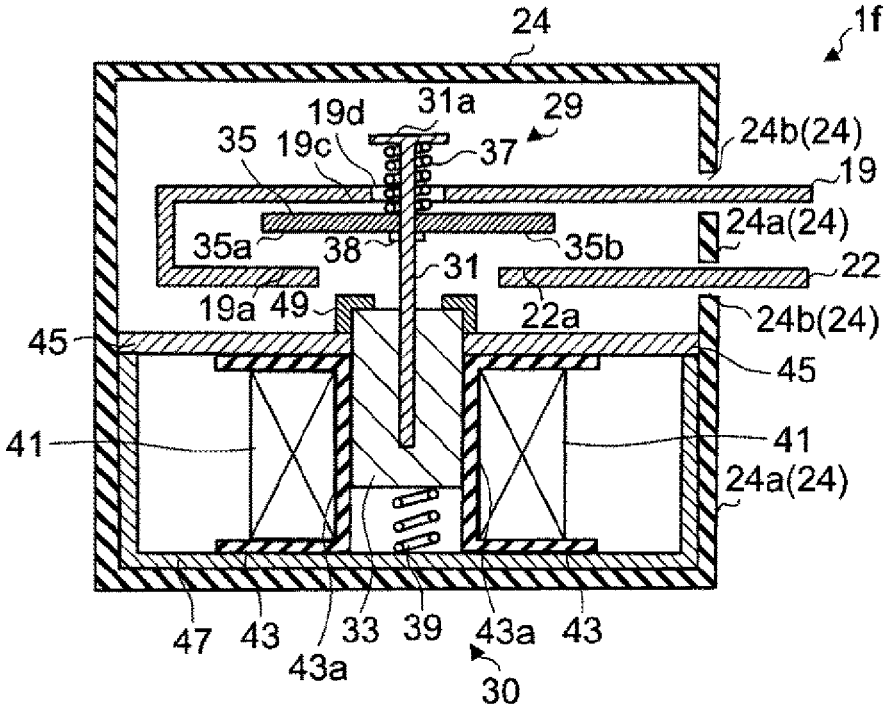
FIG. 18 is a front cross-sectional view schematically showing an electromagnetic relay in an open state according to a seventh embodiment.
Figure 19:
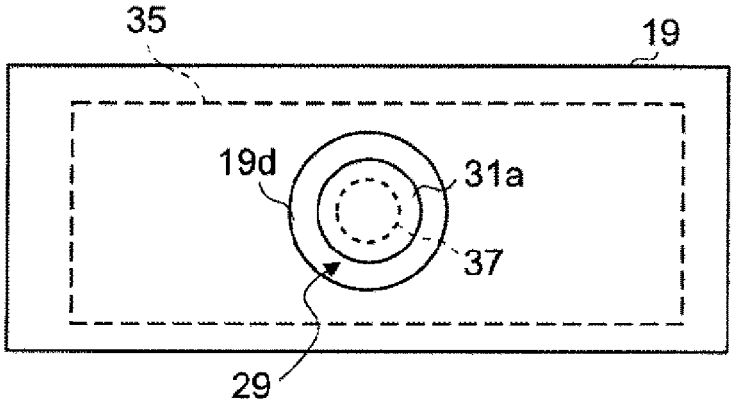
FIG. 19 is a plan view of a contact mechanism unit in a contact-making and breaking direction.
Figure 20:
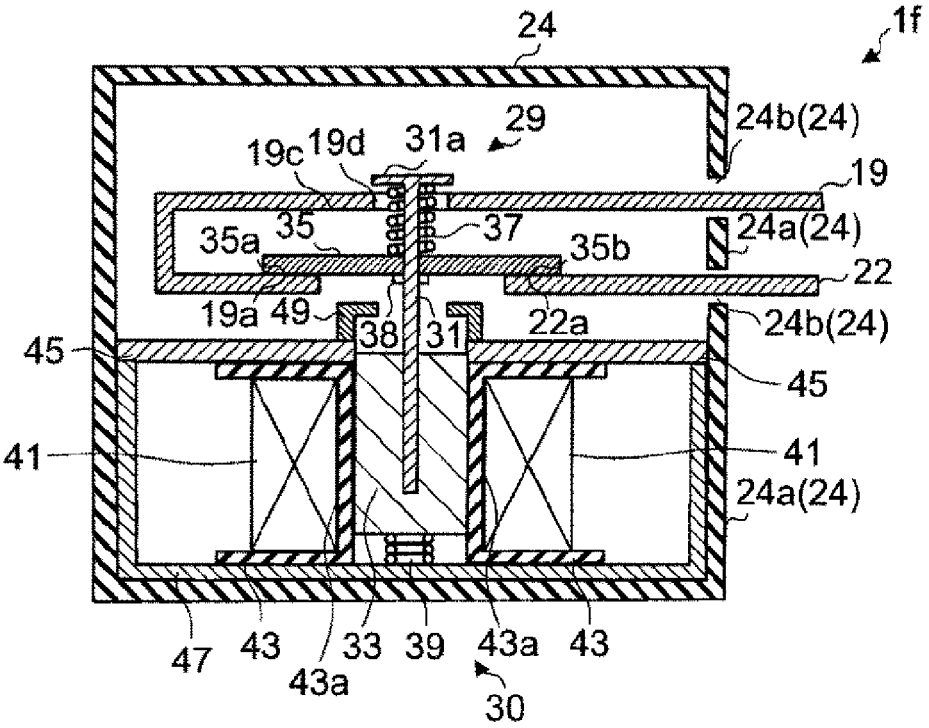
FIG. 20 is a front cross-sectional view schematically showing the electromagnetic relay in a closed state.

Next, a description will be given of an electromagnetic relay 1*f* according to a seventh embodiment of the present disclosure with reference to FIG. 18 to FIG. 20. FIG. 18 is a front cross-sectional view schematically showing an electromagnetic relay 1*f* in an open state according to the seventh embodiment. FIG. 19 is a plan view of the contact mechanism unit 29 in the contact-making and breaking direction. FIG. 20 is a front cross-sectional view schematically showing the electromagnetic relay 1*f* in a closed state. In the electromagnetic relay 1 according to the first embodiment, the contact spring 37 is located between the movable touch piece 35 and the facing portion 19*c* of the first fixed contact terminal 19. In contrast, in the electromagnetic relay 1*f* according to the seventh embodiment, the contact spring 37 is inserted through the facing portion 19*c* of the first fixed contact terminal 19. Note that the electromagnetic relay 1*f* according to the seventh embodiment is identical to the electromagnetic relay 1 according to the first embodiment in structure other than features to be described below.

The movable shaft 31 and the contact spring 37 according to the seventh embodiment are inserted through a through hole 19*d* provided through the facing portion 19*c* of the first fixed contact terminal 19. The movable shaft 31 and the contact spring 37 are each configured to move through the through hole 19*d* in the contact-making and breaking direction.

This structure allows the distance between the facing portion 19*c* of the first fixed contact terminal 19 and the movable touch piece 35 to be further reduced, which in turn makes it possible to increase the electromagnetic repulsive force F that is generated by the Lorentz force and is applied to the movable touch piece 35.

The present disclosure is not limited to the above embodiments and can be modified as follows.

Figure 21:
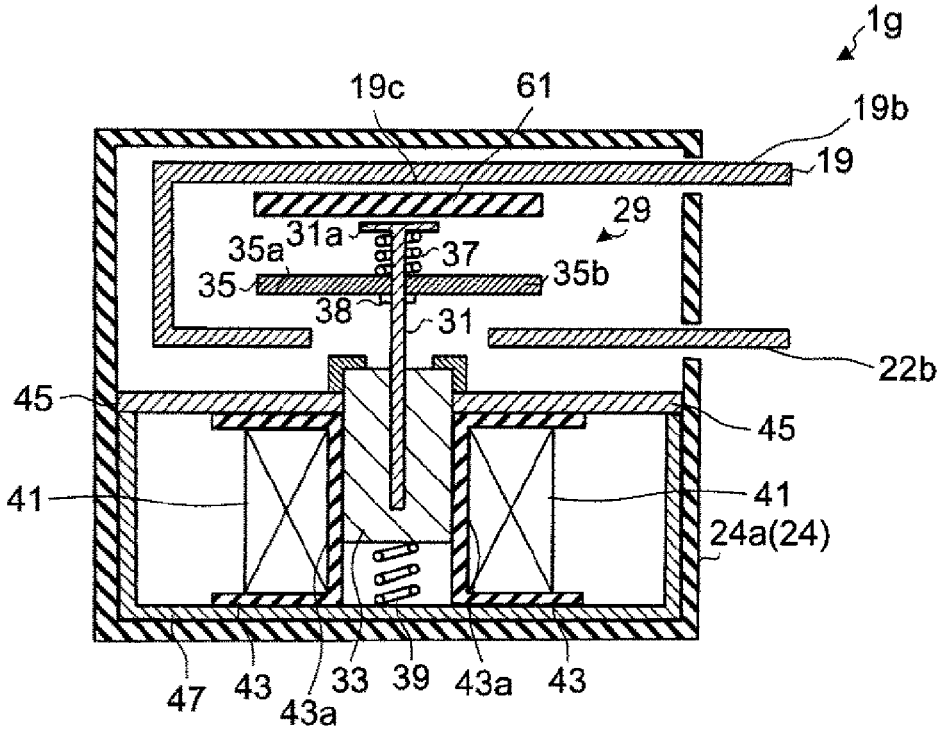
FIG. 21 is a front cross-sectional view schematically showing an electromagnetic relay according to a modification.
Figure 22:
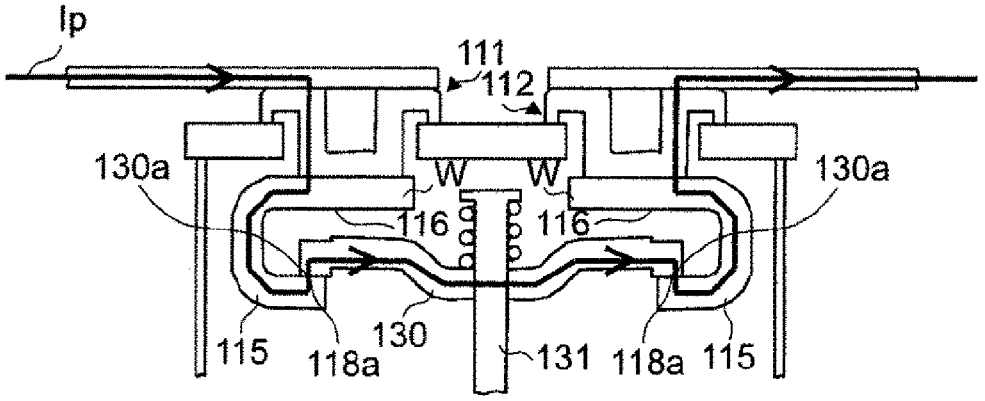
FIG. 22 is a partial front cross-sectional view of an electromagnetic relay according to a conventional example.

In each of the above embodiments, an insulating member may be disposed between the facing portion 19*c* of the first fixed contact terminal 19 and the movable touch piece 35 in the case 24. For example, when an insulating member is disposed in the first embodiment, an insulating member 61 is disposed between the facing portion 19*c* and the movable touch piece 35 as shown in an electromagnetic relay 1*g* of FIG. 21. The insulating member 61 may be made of a synthetic resin such as polyester or epoxy resin, or may be made of an inorganic material such as mica or glass fiber. The insulating member 61 can prevent a short circuit between the facing portion 19*c* of the first fixed contact terminal 19 and the movable touch piece 35. Note that the electromagnetic relay 1*g* is identical to the electromagnetic relay 1 according to the first embodiment in structure other than the above-described features.

The detailed description has been given of various embodiments according to the present disclosure with reference to the drawings, and, in conclusion, a description will be given of various aspects of the present disclosure. Note that, in the following description, reference numerals are also given as an example.

The electromagnetic relay 1, 1*a* to 1*g* of a first aspect of the present disclosure includes the case 24, the first fixed contact terminal 19 fixed to the case 24, the first fixed contact terminal 19 extending outward from an inside of the case 24 and including the first fixed contact 19*a*, the second fixed contact terminal 22 fixed to the case 24, the second fixed contact terminal 22 extending outward from the inside of the case 24 and including the second fixed contact 22*a*, and the movable touch piece 35 including, on the one surface of the movable touch piece 35, the first movable contact 35*a* and the second movable contact 35*b* configured to respectively come into and out of contact with the first fixed contact 19*a* of the first fixed contact terminal 19 and the second fixed contact 22*a* of the second fixed contact terminal 22 in the contact-making and breaking direction that is a direction in which the first movable contact 35*a* and the second movable contact 35*b* respectively come into or out of contact with the first fixed contact 19*a* and the second fixed contact 22*a*, the movable touch piece 35 being disposed in the case 24 and configured to move in the contact-making and breaking direction. In such an electromagnetic relay, the first fixed contact terminal 19 includes the facing portion 19*c* disposed facing the other surface of the movable touch piece 35 located on the opposite side of the movable touch piece 35 from the one surface in the contact-making and breaking direction, with a gap provided between the facing portion 19*c* and the movable touch piece 35 in the contact-making and breaking direction, the facing portion 19*c* extends in the direction that intersects the contact-making and breaking direction and in which the first movable contact 35*a* and the second movable contact 35*b* of the movable touch piece 35 are arranged, and at least part of the facing portion 19*c* lies over the movable touch piece 35 in plan view in the contact-making and breaking direction.

According to the electromagnetic relay 1, 1*a* to 1*g* of the first aspect, in the respective regions of the facing portion 19*c* of the first fixed contact terminal 19 and the movable touch piece 35 that lie over each other in plan view in the contact-making and breaking direction, a direction in which a current flows through the facing portion 19*c* of the first fixed contact terminal 19 extending in the direction that intersects the contact-making and breaking direction and in which the first movable contact 35*a* and the second movable contact 35*b* of the movable touch piece 35 are arranged is opposite to a direction in which a current flows through the movable touch piece 35. As a result, a force that is applied to the movable touch piece 35 to push the movable contacts to the fixed contacts is generated by the Lorentz force, and it is thus possible to increase contact pressure between the first movable contact 35*a* of the movable touch piece 35 and the first fixed contact 19*a*, and contact pressure between the second movable contact 35*b* of the movable touch piece 35 and the second fixed contact 22*a*. Therefore, the electromagnetic repulsive force F derived from the Lorentz force can prevent the movable touch piece 35 from coming out of contact with the first fixed contact terminal 19 and the second fixed contact terminal 22. Further, it is possible for the electromagnetic relay 1, 1*a* to 1*g* having the above-described structure alone to increase the contact pressure between the movable contacts and the fixed contacts, which eliminates the need for consideration of design of peripheral components such as a bus bar.

The electromagnetic relay 1, 1*a*, 1*c*, 1*d*, 1*g* of a second aspect of the present disclosure further includes the contact spring 37 disposed away from, farther than the one surface of the movable touch piece 35, a contact position, the contact spring 37 pushing the movable touch piece 35 toward the contact position in the contact-making and breaking direction. In such an electromagnetic relay, part of the movable touch piece 35 extends through between the contact spring 37 and the facing portion 19*c* of the first fixed contact terminal 19 in plan view in the direction intersecting the contact-making and breaking direction, and the movable touch piece 35 includes a current path extending from the first movable contact 35*a* to the second movable contact 35*b* through between the contact spring 37 and the facing portion 19*c* of the first fixed contact terminal 19.

According to the electromagnetic relay 1 of the second aspect, the movable touch piece 35 includes a current path extending from the first movable contact 35*a* to the second movable contact 35*b* through between the facing portion 19*c* of the first fixed contact terminal 19 and the contact spring 37 disposed away from, farther than the one surface of the movable touch piece 35, the contact position. This makes it possible to prevent, in a closed state, the movable touch piece 35 from coming out of contact with the first fixed contact terminal 19 and the second fixed contact terminal 22, with the help of not only the electromagnetic repulsive force F that causes the movable touch piece 35 and the facing portion 19*c* of the first fixed contact terminal 19 to repel each other along the current path, but also the pushing force of the contact spring 37 toward the contact position.

The electromagnetic relay 1*b* of a third aspect of the present disclosure further includes the contact spring 37 disposed on the one surface of the movable touch piece 35, the contact spring 37 pushing the movable touch piece 35 toward the contact position in the contact-making and breaking direction.

According to the electromagnetic relay 1*b* of the third aspect, the contact spring 37 having the pushing force toward the contact position is disposed on the one surface of the movable touch piece 35, and it is thus possible to arrange the facing portion 19*c* of the first fixed contact terminal 19 and the movable touch piece 35 in proximity to each other as compared with a structure where the contact spring 37 is disposed away, farther than the one surface of the movable touch piece 35, the contact position. This makes it possible to reduce the distance between the facing portion 19*c* of the first fixed contact terminal 19 and the movable touch piece 35, which in turn makes it possible to apply a larger electromagnetic repulsive force F derived from Lorentz force to the movable touch piece 35.

The electromagnetic relay 1*e* of a fourth aspect of the present disclosure further includes the movable shaft 31 supporting the movable touch piece 35, the movable shaft 31 being configured to cause the movable touch piece 35 to reciprocate in the contact-making and breaking direction, and the contact spring 37 disposed on the opposite side from the movable touch piece 35 supported by the movable shaft 31, the contact spring 37 pushing the movable touch piece 35 toward the contact position with the movable shaft 31.

According to the electromagnetic relay 1*e* of the fourth aspect, the contact spring 37 is not disposed away from, farther than the one surface of the movable touch piece 35, the contact position, and it is thus possible to arrange the facing portion 19*c* of the first fixed contact terminal 19 and the movable touch piece 35 in proximity to each other. This in turn makes it possible to increase the electromagnetic repulsive force F that is generated by the Lorentz force and is applied to the movable touch piece 35.

In the electromagnetic relay 1, 1*a* to 1*g* of a fifth aspect of the present disclosure, the facing portion 19*c* of the first fixed contact terminal 19 extends facing, in the plan view, the center portion 35*c* of the movable touch piece 35 in the direction in which the first movable contact 35*a* and the second movable contact 35*b* are arranged.

According to the electromagnetic relay 1 of the fifth aspect, since the facing portion 19*c* of the first fixed contact terminal 19 and the center portion 35*c* of the movable touch piece 35 face each other, when a current flows in a closed state, the electromagnetic repulsive force F that causes the facing portion 19*c* of the first fixed contact terminal 19 and the center portion 35*c* of the movable touch piece 35 to repel each other is generated, making it possible to push the center portion 35*c* of the movable touch piece 35 downward. This in turn makes it possible for the first movable contact 35*a* and the second movable contact 35*b* located at both ends of the movable touch piece 35 to evenly come into contact with the two fixed contacts of the first fixed contact terminal 19 and the second fixed contact terminal 22.

In the electromagnetic relay 1*g* of a sixth aspect of the present disclosure, the insulating member 61 is disposed, in the case 24, between the facing portion 19*c* of the first fixed contact terminal 19 and the movable touch piece 35.

According to the electromagnetic relay 1 of the sixth aspect, the insulating member 61 can prevent a short circuit between the facing portion 19*c* of the first fixed contact terminal 19 and the movable touch piece 35.

Note that any suitable combination of embodiments or modifications out of the various embodiments or modifications can exhibit their respective effects. Further, a combination of the embodiments, a combination of the examples, or a combination of an embodiment and an example are possible, and a combination of features in different embodiments or examples are also possible.

While the present disclosure has been fully described in connection with preferred embodiments with reference to the accompanying drawings, various variations and modifications will be apparent to those skilled in the art. Such variations and modifications are to be understood as included within the scope of the present disclosure as set forth in the appended claims.

INDUSTRIAL APPLICABILITY

The electromagnetic relay according to the present disclosure is also applicable to an electromagnetic relay provided with either a direct-current or alternating-current electromagnetic relay.

DESCRIPTION OF SYMBOLS 1, 1*a*, 1*b*, 1*c*, 1*d*, 1 *e*, 1*f*, 1*g* electromagnetic relay
3 battery
5 motor
7 inverter
8 generator
9 capacitor
10 relay
11 resistor
19 first fixed contact terminal
19*a* first fixed contact
19*b* connecting terminal
19*c* facing portion
19*d* through hole
22 second fixed contact terminal
22*a* second fixed contact
22*b* connecting terminal
24 case
24*a* outer surface
24*b* opening
29 contact mechanism unit
30 electromagnet unit
31 movable shaft
31*a* disk-shaped guard portion
31*b* hollow hole
33 movable iron core
34 hook
35 movable touch piece
35*a* first movable contact
35*b* second movable contact
35*c* center portion
35*d* first lower plate
35*e* second lower plate
35*f* upper plate
35*g* first intermediate plate
35*h* second intermediate plate
37 contact spring
38 ring
39 return spring
41 coil
43 spool
43*a* body
45 first yoke
47 second yoke
49 stopper
61 insulating member
64 hollow hole
65 ring
D section
F electromagnetic repulsive force

The invention claimed is:

1. An electromagnetic relay comprising:

a case;

a first fixed contact terminal fixed to the case, the first fixed contact terminal extending outward from an inside of the case and comprising a first fixed contact;

a second fixed contact terminal fixed to the case, the second fixed contact terminal extending outward from the inside of the case and comprising a second fixed contact;

a movable touch piece comprising, on one surface of the movable touch piece, a first movable contact and a second movable contact configured to respectively come into and out of contact with the first fixed contact of the first fixed contact terminal and the second fixed contact of the second fixed contact terminal in a contact-making and breaking direction that is a direction in which the first movable contact and the second movable contact respectively come into or out of contact with the first fixed contact and the second fixed contact, the movable touch piece being disposed in the case and configured to move in the contact-making and breaking direction; and a contact spring disposed away from, farther than the one surface of the movable touch piece, a contact position, the contact spring pushing the movable touch piece toward the contact position in the contact-making and breaking direction, wherein the first fixed contact terminal comprises a facing portion disposed facing another surface of the movable touch piece located on an opposite side of the movable touch piece from the one surface in the contact-making and breaking direction, with a gap provided between the facing portion and the movable touch piece in the contact-making and breaking direction, the facing portion extends in a direction that intersects the contact-making and breaking direction and in which the first movable contact and the second movable contact of the movable touch piece are arranged, at least part of the facing portion lies over the movable touch piece in plan view in the contact-making and breaking direction, part of the movable touch piece extends through between the contact spring and the facing portion of the first fixed contact terminal in the contact-making and breaking direction in plan view in a direction intersecting the contact-making and breaking direction, and the movable touch piece comprises a current path extending from the first movable contact to the second movable contact through between the contact spring and the facing portion of the first fixed contact terminal.

2. The electromagnetic relay according to claim 1, wherein the facing portion of the first fixed contact terminal extends, in parallel, facing a center portion of the movable touch piece in the direction in which the first movable contact and the second movable contact are arranged.

3. The electromagnetic relay according to claim 1, wherein an insulating member is disposed, in the case, between the facing portion of the first fixed contact terminal and the movable touch piece.

4. The electromagnetic relay according to claim 2, wherein an insulating member is disposed, in the case, between the facing portion of the first fixed contact terminal and the movable touch piece.

5. An electromagnetic relay comprising:

a case;

a first fixed contact terminal fixed to the case, the first fixed contact terminal extending outward from an inside of the case and comprising a first fixed contact;

a second fixed contact terminal fixed to the case, the second fixed contact terminal extending outward from the inside of the case and comprising a second fixed contact;

a movable touch piece comprising, on one surface of the movable touch piece, a first movable contact and a second movable contact configured to respectively come into and out of contact with the first fixed contact of the first fixed contact terminal and the second fixed contact of the second fixed contact terminal in a contact-making and breaking direction that is a direction in which the first movable contact and the second movable contact respectively come into or out of contact with the first fixed contact and the second fixed contact, the movable touch piece being disposed in the case and configured to move in the contact-making and breaking direction; and a contact spring disposed on the one surface of the movable touch piece, the contact spring pushing the movable touch piece toward a contact position in the contact-making and breaking direction, wherein the first fixed contact terminal comprises a facing portion disposed facing another surface of the movable touch piece located on an opposite side of the movable touch piece from the one surface in the contact-making and breaking direction, with a gap provided between the facing portion and the movable touch piece in the contact-making and breaking direction, the facing portion extends in a direction that intersects the contact-making and breaking direction and in which the first movable contact and the second movable contact of the movable touch piece are arranged, at least part of the facing portion lies over the movable touch piece in plan view in the contact-making and breaking direction, and the facing portion of the first fixed contact terminal extends, in parallel, facing a center portion of the movable touch piece in the direction in which the first movable contact and the second movable contact are arranged.

6. The electromagnetic relay according to claim 5, wherein an insulating member is disposed, in the case, between the facing portion of the first fixed contact terminal and the movable touch piece.

7. An electromagnetic relay comprising:

a case;

a first fixed contact terminal fixed to the case, the first fixed contact terminal extending outward from an inside of the case and comprising a first fixed contact;

a second fixed contact terminal fixed to the case, the second fixed contact terminal extending outward from the inside of the case and comprising a second fixed contact;

a movable touch piece comprising, on one surface of the movable touch piece, a first movable contact and a second movable contact configured to respectively come into and out of contact with the first fixed contact of the first fixed contact terminal and the second fixed contact of the second fixed contact terminal in a contact-making and breaking direction that is a direction in which the first movable contact and the second movable contact respectively come into or out of contact with the first fixed contact and the second fixed contact, the movable touch piece being disposed in the case and configured to move in the contact-making and breaking direction;

a movable shaft supporting the movable touch piece, the movable shaft being configured to cause the movable touch piece to reciprocate in the contact-making and breaking direction; and a contact spring disposed on an opposite side of the movable shaft from the movable touch piece supported by the movable shaft, the contact spring pushing the movable touch piece toward a contact position with the movable shaft, wherein the first fixed contact terminal comprises a facing portion disposed facing another surface of the movable touch piece located on an opposite side of the movable touch piece from the one surface in the contact-making and breaking direction, with a gap provided between the facing portion and the movable touch piece in the contact-making and breaking direction, the facing portion extends in a direction that intersects the contact-making and breaking direction and in which the first movable contact and the second movable contact of the movable touch piece are arranged, at least part of the facing portion lies over the movable touch piece in plan view in the contact-making and breaking direction, and the facing portion of the first fixed contact terminal extends, in parallel, facing a center portion of the movable touch piece in the direction in which the first movable contact and the second movable contact are arranged.

8. The electromagnetic relay according to claim 7, wherein an insulating member is disposed, in the case, between the facing portion of the first fixed contact terminal and the movable touch piece.

* * * * *